US007909172B2

(12) United States Patent
Carr

(10) Patent No.: US 7,909,172 B2
(45) Date of Patent: Mar. 22, 2011

(54) COMPOSITE SCREEN WITH INTEGRAL INFLATABLE SEAL

(75) Inventor: Brian S. Carr, Burlington, KY (US)

(73) Assignee: M-I L.L.C., Houston, TX (US)

( * ) Notice: Subject to any disclaimer, the term of this patent is extended or adjusted under 35 U.S.C. 154(b) by 504 days.

(21) Appl. No.: 11/860,479

(22) Filed: Sep. 24, 2007

(65) Prior Publication Data

US 2008/0078697 A1 Apr. 3, 2008

Related U.S. Application Data

(60) Provisional application No. 60/827,598, filed on Sep. 29, 2006.

(51) Int. Cl.
*B07B 1/49* (2006.01)

(52) U.S. Cl. ..... 209/405; 209/393; 209/395; 209/403

(58) Field of Classification Search ..... 209/395, 209/397, 399, 403, 405, 412
See application file for complete search history.

(56) References Cited

U.S. PATENT DOCUMENTS

| | | | | |
|---|---|---|---|---|
| 4,816,153 | A * | 3/1989 | Ando et al. | 210/445 |
| 5,226,546 | A | 7/1993 | Janssens et al. | |
| 5,271,630 | A * | 12/1993 | Arlt et al. | 277/605 |
| 6,675,975 | B1 * | 1/2004 | Cook et al. | 210/490 |
| 6,708,829 | B2 * | 3/2004 | Robertson et al. | 209/405 |
| 6,713,190 | B2 | 3/2004 | Cook et al. | |
| 6,759,000 | B2 | 7/2004 | Cook et al. | |
| 7,063,214 | B2 * | 6/2006 | Schulte et al. | 209/405 |
| 7,721,896 | B2 * | 5/2010 | Mainwaring et al. | 209/405 |
| 2003/0042178 | A1 * | 3/2003 | Robertson et al. | 209/405 |
| 2004/0074816 | A1 * | 4/2004 | Seyffert et al. | 209/363 |

OTHER PUBLICATIONS

Notification of Transmittal of the International Search Report and The Written Opinion of the International searching Authority, or the Declaration, for International Application No. PCT/US2007/079789 dated Feb. 4, 2008, (3 pages).
Written Opinion of the International Searching Authority, for International Application No. PCT/US2007/079789, dated Feb. 4, 2008, (5 pages).
International Search Report for International Application No. PCT/US2007/079789, dated Feb. 4, 2008, (2 pages).

* cited by examiner

*Primary Examiner* — Terrell H Matthews

(57) ABSTRACT

A shaker screen including a screen frame and an inflatable sealing element integrally formed with the screen frame is disclosed. A screen sealing system including a plurality of shaker screens, each shaker screen having a screen frame and an inflatable sealing element integrally formed with the screen frame, wherein the inflatable sealing elements of each shaker screen are in fluid communication is also disclosed. A method of sealing a composite screen including assembling at least one shaker screen within a shale shaker and inflating at least one inflatable sealing element disposed along at least a portion of a perimeter of the screen frame, the portions selected from a group consisting of a top surface, a bottom surface, and an outer surface is disclosed.

21 Claims, 6 Drawing Sheets

COMPOSITE SCREEN WITH INTEGRAL INFLATABLE SEAL

CROSS-REFERENCE TO RELATED APPLICATIONS

This application, pursuant to 35 U.S.C. §119(e), claims priority to U.S. Provisional Application Ser. No. 60/827,598, filed Sep. 29, 2006. That application is incorporated by reference in its entirety.

BACKGROUND

1. Field

The invention relates generally to oilfield shale shakers. More particularly, embodiments disclosed herein relate to seals for screen frames for oilfield shale shakers.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. Typically, the shale shaker is an angled table with a generally perforated filter screen bottom. Returning drilling fluid is deposited at the feed end of the shale shaker. As the drilling fluid travels down length of the vibrating table, the fluid falls through the perforations to a reservoir below leaving the solid particulate material behind. The vibrating action of the shale shaker table conveys solid particles left behind until they fall off the discharge end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling fluid flow rates and particulate percentages in the drilling fluid. After the fluid passes through the perforated bottom of the shale shaker, it can either return to service in the borehole immediately, be stored for measurement and evaluation, or pass through an additional piece of equipment (e.g., a drying shaker, centrifuge, or a smaller sized shale shaker) to further remove smaller cuttings.

Because shale shakers are typically in continuous use, any repair operations and associated downtimes are to be minimized as much as possible. Often, the filter screens of shale shakers, through which the solids are separated from the drilling mud, wear out over time and need replacement. Therefore, shale shaker filter screens are typically constructed to be quickly and easily removed and replaced. Generally, through the loosening of only a few bolts, the filter screen can be lifted out of the shaker assembly and replaced within a matter of minutes. While there are numerous styles and sizes of filter screens, they generally follow similar design. Typically, filter screens include a perforated plate base upon which a wire mesh, or other perforated filter overlay, is positioned. The perforated plate base generally provides structural support and allows the passage of fluids therethrough, while the wire mesh overlay defines the largest solid particle capable of passing therethrough. While many perforated plate bases are generally flat or slightly curved in shape, it should be understood that perforated plate bases having a plurality of corrugated channels extending thereacross may be used instead. In theory, the corrugated channels provide additional surface area for the fluid-solid separation process to take place, and act to guide solids along their length toward the end of the shale shaker from where they are disposed.

A typical shale shaker filter screen includes a plurality of hold-down apertures at opposite ends of the filter screen. These apertures, preferably located at the ends of the filter screen that will abut walls of the shale shaker, allow hold down retainers of the shale shaker to grip and secure the filter screens in place. However, because of their proximity to the working surface of the filter screen, the hold-down apertures must be covered to prevent solids in the returning drilling fluid from bypassing the filter mesh through the hold-down apertures. To prevent such bypass, an end cap assembly is placed over each end of the filter screen to cover the hold-down apertures. Presently, these caps are constructed by extending a metal cover over the hold down apertures and attaching a wiper seal thereto to contact an adjacent wall of the shale shaker. Furthermore, epoxy plugs are set in each end of the end cap to prevent fluids from communicating with the hold-down apertures through the sides of the end cap.

Typically, screens used with shale shakers are emplaced in a generally horizontal fashion on a generally horizontal bed or support within a basket in the shaker. The screens themselves may be flat or nearly flat, corrugated, depressed, or contain raised surfaces. The basket in which the screens are mounted may be inclined towards a discharge end of the shale shaker. The shale shaker imparts a rapidly reciprocating motion to the basket and hence the screens. Material from which particles are to be separated is poured onto a back end of the vibrating screen. The material generally flows toward the discharge end of the basket. Large particles that are unable to move through the screen remain on top of the screen and move toward the discharge end of the basket where they are collected. The smaller particles and fluid flow through the screen and collect in a bed, receptacle, or pan beneath the screen.

In some shale shakers a fine screen cloth is used with the vibrating screen. The screen may have two or more overlying layers of screen cloth or mesh. Layers of cloth or mesh may be bonded together and placed over a support, supports, or a perforated or apertured plate. The frame of the vibrating screen is resiliently suspended or mounted upon a support and is caused to vibrate by a vibrating mechanism (e.g., an unbalanced weight on a rotating shaft connected to the frame). Each screen may be vibrated by vibratory equipment to create a flow of trapped solids on top surfaces of the screen for removal and disposal of solids. The fineness or coarseness of the mesh of a screen may vary depending upon mud flow rate and the size of the solids to be removed.

Currently, in many shale shakers, the seal between the screen and the shaker basket is formed by a gasket disposed along the inner perimeter of the shaker basket. In addition to the gasket, a steel rigid support member is often affixed along longitudinal and lateral support members disposed on a bottom or inner surface of the shaker basket upon which the steel frame of the shaker screen rests. The weight of the screen and the disposition of a wedge member between the shaker basket and the screen compresses the gasket between the shaker basket and the frame of the screen. In such an assembly, the compression of the gasket is limited by the thickness of the steel rigid support member. Thus, a relatively thin steel rigid support member will result in greater gasket compression and less space between the screen and the shaker basket. Correspondingly, a relatively thick steel rigid support member will result in less gasket compression and more space between the screen and the shaker basket.

In shale shakers using a steel rigid support member to define the compression between the gasket and the shaker basket, an overly compressed gasket may cause the wedge to loosen and the screen to become loose. When a gasket is overly compressed, the vibrations of the shale shaker may cause the screen to move vertically relative to the shale shaker. When such vertical screen movement occurs, drilling fluid and/or cuttings may pass between the screen and the shaker basket, therein bypassing the screen. The bypassing of such drilling fluid and/or cuttings may decrease the efficiency of the shaking process, as well as allowing cutting matter to settle between the gasket and the shaker basket, thereby resulting in the loss of additional drilling fluid.

When drill cuttings and/or fluid is allowed constant contact with the sealing element of a shale shaker, the sealing element may wear out relatively quickly. In such systems wherein the sealing element is disposed and/or attached to the inner diameter of the shaker basket, replacing the sealing element can be a time consuming process that requires shutting down the shaker system, thus decreasing the efficiency of the process.

Accordingly, there exists a need for a screen frame assembly that may be securely positioned within a shale shaker while effectively reducing the amount of cutting particulates that may bypass the screen. Further, there exists a need for forming a seal against a wall of the shaker and neighboring screens, thereby minimizing the passage of unfiltered drilling mud therethrough.

SUMMARY OF INVENTION

In one aspect, embodiments disclosed herein relate to a shaker screen including a screen frame and an inflatable sealing element integrally formed with the screen frame.

In another aspect, embodiments disclosed herein relate to a screen sealing system including a plurality of shaker screens, each shaker screen having a screen frame and an inflatable sealing element integrally formed with the screen frame, wherein the inflatable sealing elements of each shaker screen are in fluid communication.

In another aspect, embodiments disclosed herein relate to a method of sealing a composite screen including assembling at least one shaker screen within a shale shaker and inflating at least one inflatable sealing element disposed along at least a portion of a perimeter of the screen frame, the portions selected from a group consisting of a top surface, a bottom surface, and an outer surface.

Other aspects and advantages of the invention will be apparent from the following description and the appended claims.

DETAILED DESCRIPTION

Generally, embodiments disclosed herein relate to apparatuses and methods for efficiently sealing shaker screens. More specifically, embodiments disclosed herein relate to shaker screens for inflatably sealing screen frames. Additionally, embodiments disclosed herein relate to inflatable screen sealing systems for shale shakers.

Figure 1:
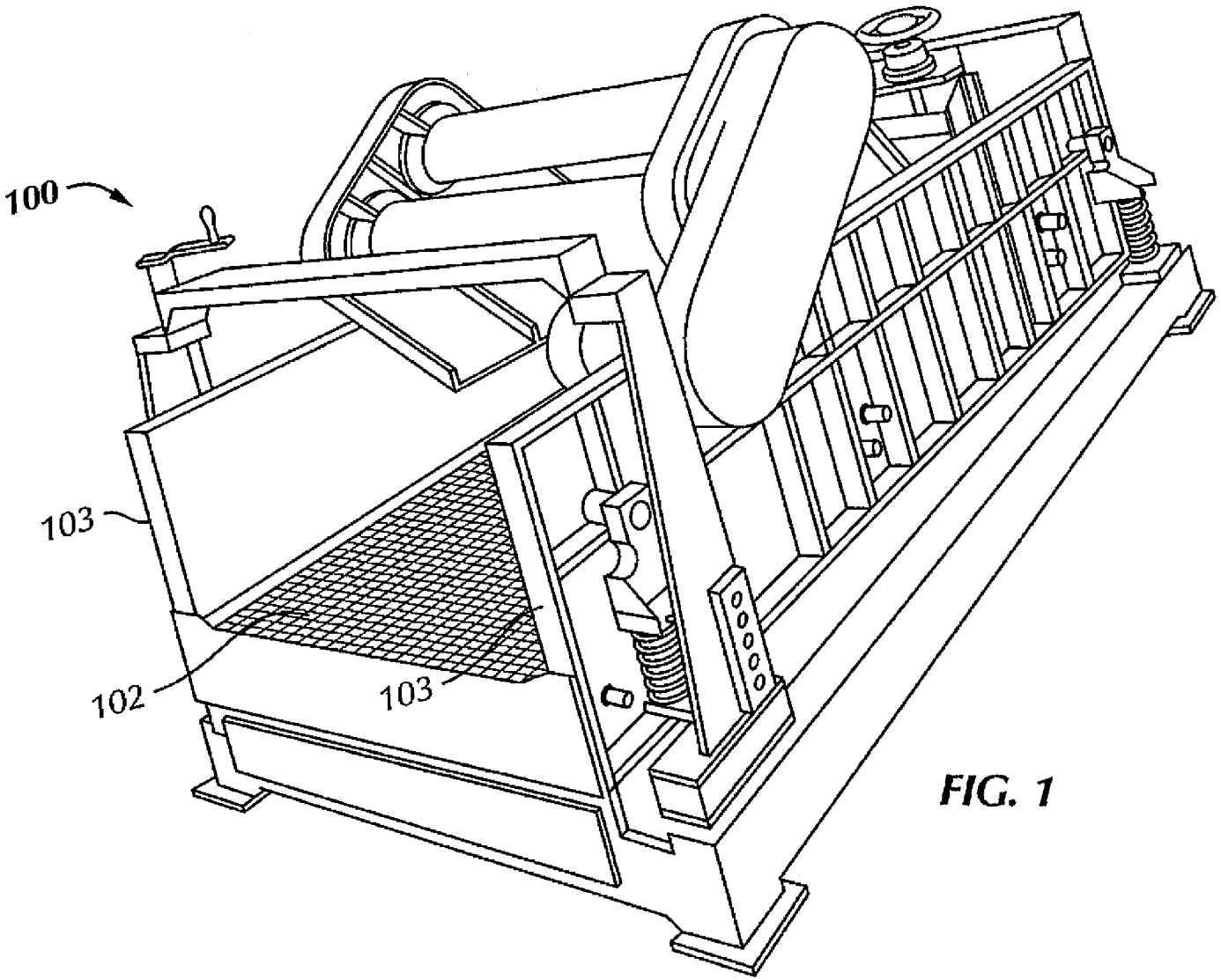
FIG. 1 is perspective view of a vibratory shaker in accordance with embodiments disclosed herein.

Referring to FIG. 1, a vibratory shaker 100 is shown. As shown, a screen 102 is detachably secured to vibratory shaker 100. With the screen or a plurality of screens secured in place, a tray is formed with the opposed, parallel sidewalls 103 of shaker 100. Drilling mud, along with drill cuttings and debris, is deposited on top of screen 102 at one side. Screen 102 is vibrated at a high frequency or oscillation by a motor or motors for the purpose of screening or separating the drilling mud on screen 102. The liquid and fine particles will pass through screen 102 by force of gravity and be recovered underneath. Solid particles above a certain size migrate and vibrate across screen 102 where they are discharged. Screen 102 may include filtering elements attached to a screen frame (not shown). The filtering elements may further define the largest solid particle capable of passing therethrough.

In one embodiment, a screen frame may be formed from any material known in the art, for example, stainless steel, metal alloys, plastics, etc. In a preferred embodiment, the screen frame may be formed from a composite material. In this embodiment, the composite material may include high-strength plastic and glass, reinforced with steel rods. Composite screen frames may allow for more consistent manufacturing of the frame and may more evenly distribute mechanical stresses throughout the screen frame during operation. In another embodiment, screen frame may include composite material formed around a steel or wire frame. Additionally, the screen frame may be formed by injection molding. U.S. Pat. No. 6,759,000 discloses a method of forming a screen frame by injection molding, and is herein incorporated by reference in its entirety. For example, in one embodiment, a screen frame having a wire frame and a composite or polymer material, may be formed by first placing a reinforcing wire frame assembly including at least a first end, a second end, a first side, a second side, and at least one cross-member in a mold tool.

The mold tool may then be closed and liquid polymer may be injected into the mold tool (i.e., by injection molding) so as to encapsulate the wire frame and form an article having an open central region crisscrossed by transverse ribs bounding each side of the frame. An inward force may then be exerted on opposite faces of the wire frame assembly within the mold tool by fingers protruding inwardly from inside faces of the mold tool, the fingers being operable to engage the reinforcing wire frame when the mold tool closes. The fingers include inwardly projecting pegs that align with crossing points of wires to space the reinforcing wire frame from corresponding upper and lower internal surfaces of the mold tool, thereby ensuring that the reinforcing wire frame is buried within the polymer or composite material which is injected into the mold tool during the manufacturing process. The polymer or composite material is allowed to cure and then the screen frame may be removed from the mold tool.

Figure 2A:
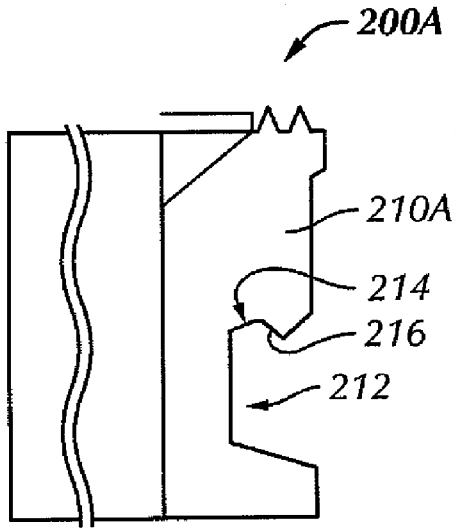
FIGS. 2A-2C show partial cross-sectional views of shaker screens in accordance with embodiments disclosed herein.

In one embodiment, a plurality of shaker screens may be disposed in the shaker. As shown in FIG. 2A, each shaker screen 200A may include a screen frame 210A and at least one filtering element (not shown). The at least one filtering element decreases the size of particulate matter that may pass through shaker screen 200A. In such applications, the filtering element (not shown) may be attached to screen frame 210A so as to limit the size of particulate matter which may pass therethrough. In one embodiment, the filtering element (not shown) may include, for example, a mesh, a fine screen cloth, or other materials known to one of ordinary skill in the art. Additionally, the filtering element (not shown) may be formed from plastics, metals, alloys, fiberglass, composites, and polytetrafluoroethylene. In certain embodiments, a plurality of layers of filtering elements (not shown) may be incorporated into one shaker screen 200A to define a desired separation efficiency or cut. However, in alternate embodiments, the filtering element (not shown) may include a single layer (not shown).

Figure 2B:
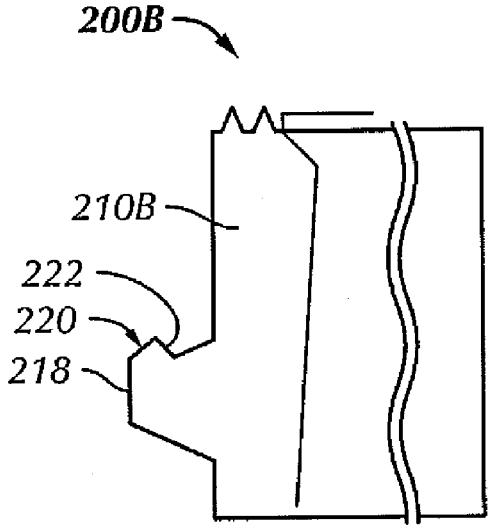
Figure 2C:
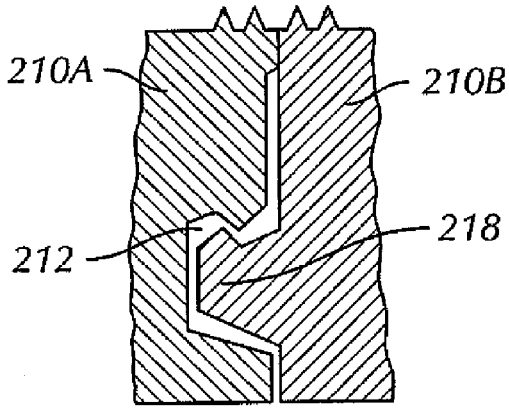

Referring now to FIGS. 2A-2C, in one embodiment, the plurality of shaker screens may form an interlocking system of shaker screens. An interlocking system of shaker screens may reduce or limit the amount of separation between the shaker screens, thereby reducing the gap or space unfiltered drilling fluid may leak through. One example of interlocking shaker screens is disclosed in U.S. Pat. No. 6,713,190, and is herein incorporated by reference in its entirety. In one embodiment, a first screen 200A includes a screen frame 210A having a groove 212 formed along at least a portion of a perimeter of an outer surface. The groove 212 includes an undercut portion 214 having an inclined underside 216. A second screen 200B disposed adjacent first screen 200A in the vibratory shaker (not shown), may include a screen frame 210B having a hooked protrusion 218 formed along at least a portion of a perimeter of an outer surface. Hooked protrusion 218 may include a ridge 220 configured to engage undercut portion 214 of first frame 210A and an inclined portion 222 configured to engage inclined underside 216. FIG. 2C shows first and second frames 210A, 210B assembled and interlocked.

Figure 3A:
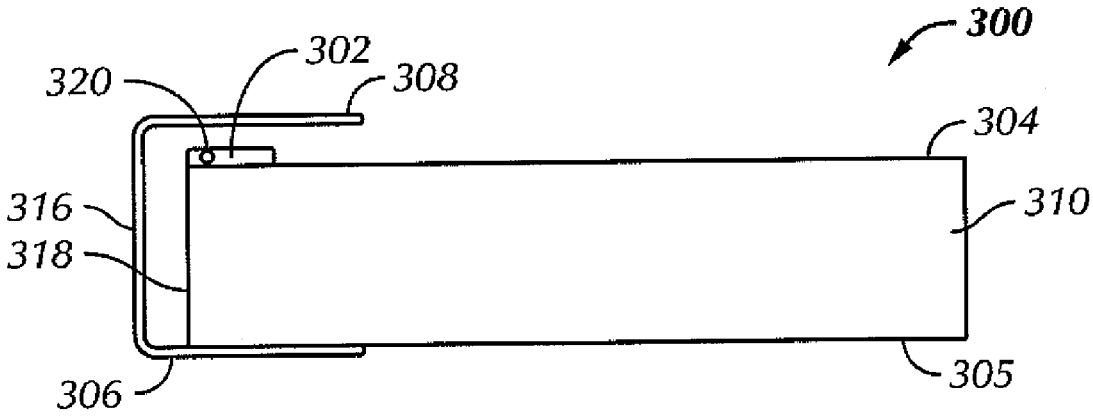
FIGS. 3A-3C show partial side views of shaker screens in accordance with embodiments disclosed herein.
Figure 3B:
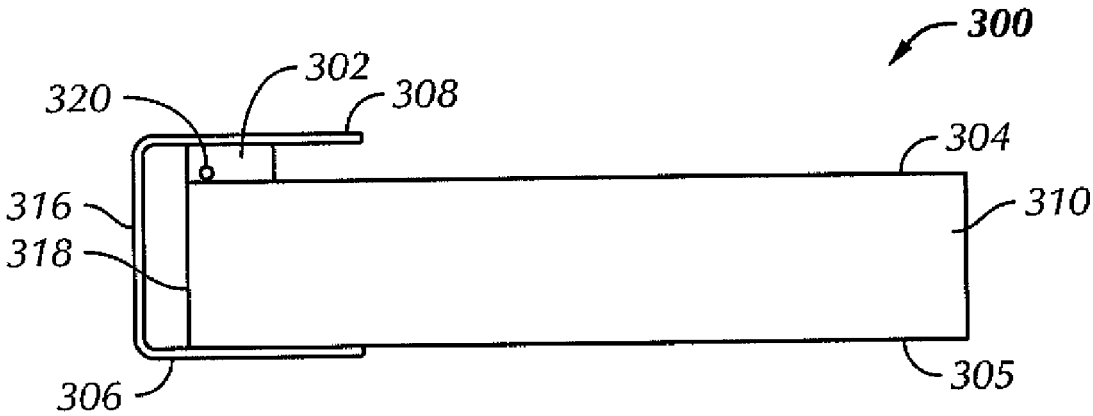

Referring to FIGS. 3A and 3B, a side view of a shaker screen 300 in accordance with an embodiment is shown. Shaker screen 300 is disposed on a support rail 306 and located below a bracing surface 308 attached to an inside wall 316 of a shaker basket (not shown). In this embodiment, shaker screen 300 includes a screen frame 310. At least one filtering element (not shown), as discussed above, may also be attached to screen frame 310. In one embodiment, an inflatable sealing element 302 is disposed along at least a portion of a perimeter of a top surface 304 of screen frame 310. In this embodiment, a fluid may be injected into inflatable sealing element 302 through inlet 320, thereby inflating inflatable sealing element 302 into sealing contact with bracing surface 308, as shown in FIG. 3B. One of ordinary skill in the art will appreciate that the fluid may be a gas (e.g., air), a liquid, or a gel. Inflation of inflatable sealing element 302, and the corresponding sealing contact with bracing surface 308, pushes shaker screen 300 downward into sealing engagement with support rail 306. Thus, the need for typical wedge blocks may be eliminated. Additionally, inflatable sealing element 302 may reduce or prevent leakage of unfiltered drilling fluid over sides 318 of the shaker screen 300. One of ordinary skill in the art will appreciate that in one embodiment, a wedge block may also be used in combination with a shaker screen having an inflatable sealing element, as disclosed herein, without departing from the scope of embodiments disclosed herein.

Figure 3C:
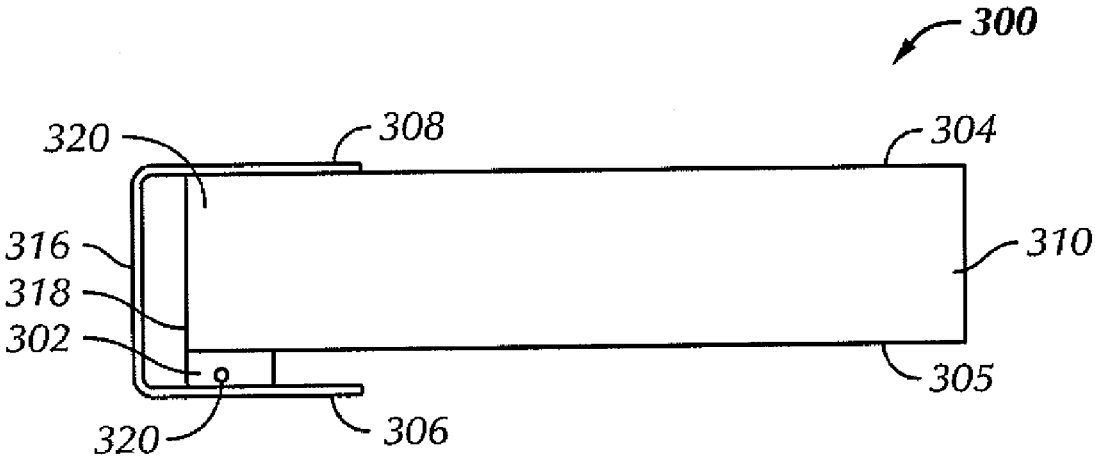

In an alternative embodiment, as shown in FIG. 3C (in an inflated state), an inflatable sealing element 302 may be disposed along at least a portion of a perimeter of a bottom surface 305 of screen frame 310. In this embodiment, a fluid may be injected into inflatable sealing element 302 through inlet 320, thereby inflating inflatable sealing element 302 and lifting the screen frame 310 into sealing contact with bracing surface 308. Accordingly, inflation of inflatable sealing element 302, and the corresponding sealing contact between the top surface 304 of screen frame 310 and bracing surface 308, securely positions shaker screen 300 in the shaker (not shown). Additionally, inflatable sealing element 302 may reduce or prevent leakage of unfiltered drilling fluid over sides 318 of the shaker screen 300. In yet other embodiments, an inflatable sealing element 302 may be disposed on a screen frame having an interlocking system like that discussed above in FIGS. 2A-2C.

One of ordinary skill in the art will appreciate that in one embodiment, inflatable sealing element 302 may include one or multiple sealing elements disposed along a portion of the perimeter or along the entire perimeter of the top or bottom surface 304, 305 of shaker screen 300. Further, inflatable sealing element 302 may be formed from any material known in the art including, but not limited to, rubbers, plastics, thermoplastic elastomers ("TPE"), foams, polychloroprene, polypropylene, nylon, mylar, composites, and/or any combinations thereof.

In one embodiment, inflatable sealing element 302 may be integrally formed with screen frame 310 of shaker screen 300. In this embodiment, inflatable sealing element 302 may be positioned within an injection mold for screen frame 310. Once the mold is sealed, a sealing element material (e.g., TPE) may be injected into the mold. The sealing element material may be allowed to cure, and then the screen frame including an integrally molded sealing element may be removed. One of ordinary skill in the art will realize that alternative methods of attaching a sealing element to a composite frame exist, for example, using an adhesive resin, and as such, are within the scope of the present disclosure.

In one embodiment, an air supply (not shown), for example, an air hose extending from an air pump, may be connected to inlet 320 to inject air into inflatable sealing element 302. In one embodiment, where multiple shaker screens 300 are disposed in vibratory shaker 300, each inflatable sealing element 302 disposed on each screen frame 310 may include inlet 320 and an outlet (not shown). The inlet 320 of a second screen frame may be in fluid connection with the outlet (not shown) of a first screen frame 310 by any means known in the art, for example, tubing, such that, when air is injected into the first inflatable sealing element 302 of the first screen frame, it also inflates the second inflatable sealing element of the second screen frame. An outlet of an inflatable sealing element may be sealed or capped to prevent air from leaking, thereby sealing the air within the sealing elements and allowing the inflatable sealing element 302 to inflate.

Figure 4A:
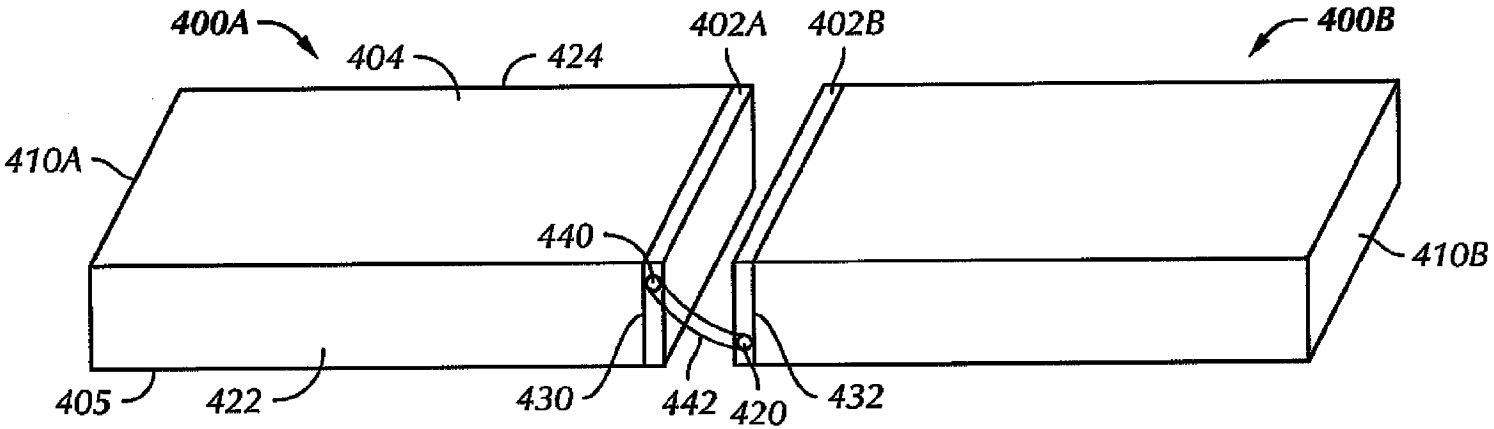
FIGS. 4A-4B show perspective views of shaker screens in accordance with embodiments disclosed herein.
Figure 4B:
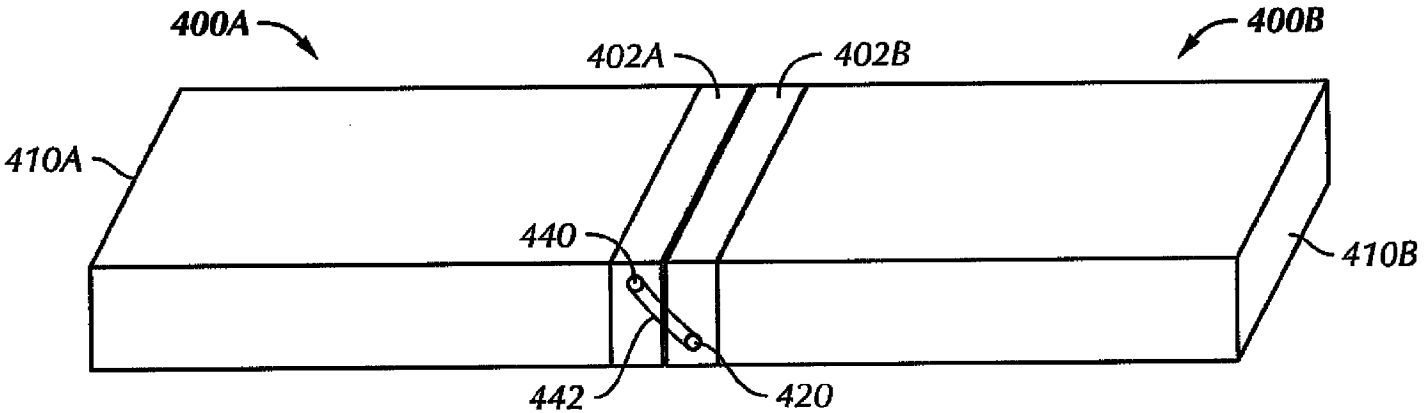

Referring now to FIGS. 4A and 4B, a screen sealing system in accordance with embodiments disclosed herein is shown. In this embodiment, a first screen 400A is disposed adjacent a second screen 400B in a vibratory shaker (not shown). Shaker screens 400A, 400B include screen frames 410A, 410B, respectively. At least one filtering element (not shown), as discussed above, may be attached to each screen frame 410A, 410B. In one embodiment, a first inflatable sealing element 402A is disposed along at least a portion of a perimeter of an outer surface 430 of first screen 400A. As shown, inflatable sealing element 402A may extend from top surface 404 to bottom surface 405 of screen frame 410A. However, one of ordinary skill in the art will appreciate that first inflatable sealing element 402A may extend along a selected portion between top surface 404 and bottom surface 405. Furthermore, although shown to extend from a first side 422 to a second side 424 of screen frame 410A, inflatable sealing element 402A may extend along a selected portion or portions between first side 422 and second side 424. Accordingly, the size and shape of inflatable sealing element 402A may vary without departing from the scope of embodiments disclosed herein.

In the embodiment shown, a second inflatable sealing element 402B is disposed along at least a portion of a perimeter of an outer surface 432 of second screen 400B. Second inflatable sealing element 402B is disposed proximate first inflatable sealing element 402A. First inflatable sealing element 402A has an inlet (not shown) and an outlet 440. Similarly, second inflatable sealing element 402B has an inlet 420 and an outlet (not shown). In this embodiment, the outlet 440 of first inflatable sealing element 402A and the inlet 420 of the second inflatable sealing element 402B are in fluid communication. The inflatable sealing elements 402A, 402B may be in fluid communication by any means known in the art. For example, as shown, a small piece of tubing 442 may connect the outlet 440 of first inflatable sealing element 402A and the inlet 420 of the second inflatable sealing element 402B. In one embodiment, the tubing 442 may threadedly connect the outlet 440 and inlet 420. In this embodiment, the outlet (not shown) of the second inflatable sealing element 402B may be sealed or capped so that the first and second inflatable sealing elements 402A, 402B inflate when a fluid is introduced to the inlet (not shown) of the first inflatable sealing element 402A. One of ordinary skill in the art will appreciate that in certain embodiments, wherein a vibratory shaker includes a single shaker screen having a single inflatable sealing element, the inflatable sealing element may have a single inlet/outlet. One of ordinary skill in the art will also appreciate that a fluid may include a gas (e.g., air), a liquid, or a gel. FIG. 4B shows the first and second shaker screens 400A, 400B when the first and second inflatable sealing elements 402A, 402B are inflated.

In one embodiment, a fluid supply (not shown), for example, an air hose extending from an air pump, may be connected to inlet (not shown) to inject air into inflatable sealing element 402A. The air passes through outlet 440 of first screen frame 410A, through tubing 442, and enters inlet 420 of second screen frame 410B, thereby inflating second inflatable sealing element 402B. An outlet (not shown) of a second inflatable sealing element 403B may be sealed or capped to prevent air from leaking, thereby sealing the air within the first and second sealing elements 402A, 402B.

Figure 5:
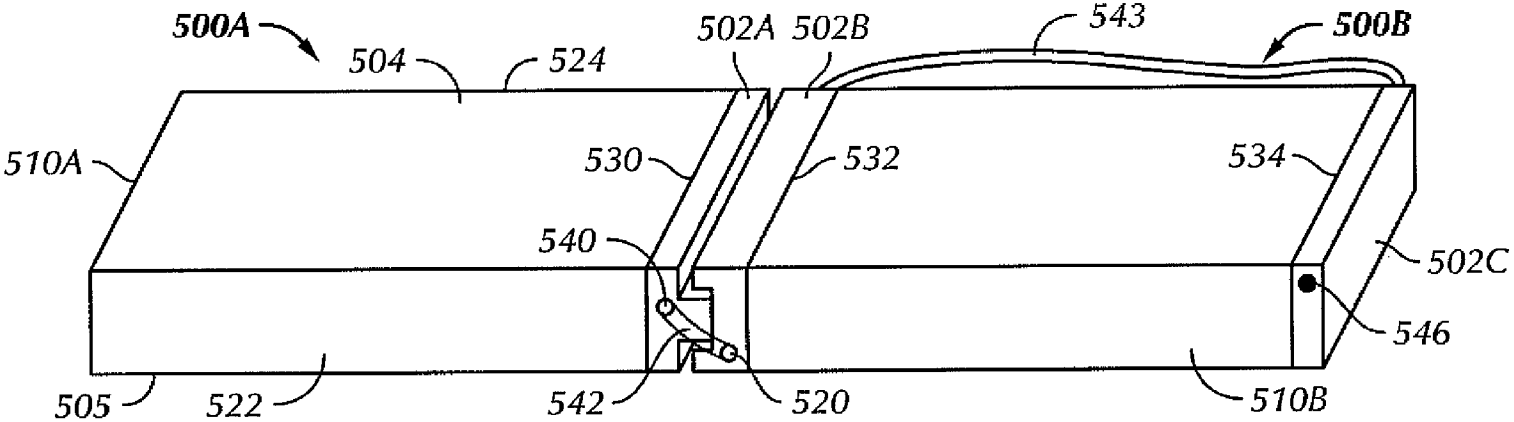
FIG. 5 shows a perspective view of shaker screens in accordance with embodiments disclosed herein.

Referring now to FIG. 5, a perspective view of screen sealing system in accordance with another embodiment disclosed herein is shown. In this embodiment, a first screen 500A is disposed adjacent a second screen 500B in a vibratory shaker (not shown). Shaker screens 500A, 500B include screen frames 510A, 510B, respectively. At least one filtering element (not shown), as discussed above, may be attached to each screen frame 510A, 510B. In one embodiment, a first inflatable sealing element 502A is disposed along at least a portion of a perimeter of an outer surface 530 of first screen 500A. As shown, inflatable sealing element 502A may extend from a top surface 504 to a bottom surface 505 of screen frame 510. However, one of ordinary skill in the art will appreciate that first inflatable sealing element 502A may also extend along a selected portion between top surface 504 and bottom surface 505. Furthermore, although shown to extend from a first side 522 to a second side 524 of screen frame 410A, inflatable sealing element 502A may extend along a selected portion or portions between first side 422 and second side 424. Accordingly, the size and shape of inflatable sealing element 402A may vary without departing from the scope of embodiments disclosed herein.

In the embodiment shown, a second inflatable sealing element 502B is disposed along at least a portion of a perimeter of an outer surface 532 of second screen 500B. Second inflatable sealing element 502B is disposed proximate first inflatable sealing element 502A. First inflatable sealing element 502A has an inlet (not shown) and an outlet 540. Similarly, second inflatable sealing element 502B has an inlet 520 and an outlet (not shown). In this embodiment, the outlet 540 of first inflatable sealing element 502A and the inlet 520 of the second inflatable sealing element 502B are in fluid communication. The inflatable sealing elements 502A, 502B may be in fluid communication by any means known in the art. For example, as shown, a small piece of tubing 542 may connect the outlet 540 of first inflatable sealing element 502A and the inlet 520 of the second inflatable sealing element 502B. In one embodiment, the tubing 542 may be threadedly connected to the outlet 540 and inlet 520.

When inflated, first and second inflatable sealing elements 502A, 502B may engage in a male/female arrangement. As shown, first inflatable sealing element 502A may have a substantially male connection shape, while second inflatable sealing element 502B may have a substantially female connection shape. Accordingly, as a fluid is injected into inflatable sealing elements 502A, 502B, inflatable sealing elements 502A, 502B are inflated into sealing and interlocking engagement. Thus, leakage of unfiltered drilling fluid between adjacent shaker screens 500A, 500B may be reduced.

In one embodiment, a third inflatable sealing element 502C may be disposed along at least a portion of a perimeter of an outer surface 534 of second screen 500B. The third inflatable sealing element 502C includes an inlet (not shown) and an outlet 546. In this embodiment, the outlet (not shown) of the second inflatable sealing element 502B is in fluid connection with the inlet (not shown) of the third inflatable sealing element 502C. Inflatable sealing elements 502B, 502C may be in fluid communication by any means known in the art. For example, as shown, a piece of tubing 543 may connect the outlet (not shown) of second inflatable sealing element 502B and the inlet (not shown) of the third inflatable sealing element 502C. In one embodiment, the tubing 543 may be threadedly connected to the outlet (not shown) and/or inlet (not shown). In one embodiment, the outlet 546 of third inflatable sealing element 502C may be sealed or capped so that first, second, and third inflatable sealing elements 502A, 502B, 502C inflate when a fluid is introduced to the inlet (not shown) of the first inflatable sealing element 502A. Note that FIG. 5 shows the first and second shaker screens 500A, 500B when the first, second, and third inflatable sealing elements 502A, 502B, 502C are inflated. Accordingly, when inflated, leakage of unfiltered drilling fluid between adjacent shaker screens 500A, 500B and/or between shaker screen 500B and a wall of a shaker basket (not shown) may be reduced.

In one embodiment, a fluid supply (not shown), for example, an air hose extending from an air pump, may be connected to inlet (not shown) to inject air into inflatable sealing element 502A. The air passes through outlet 540 of first screen frame 510A, through tubing 542, and enters inlet 520 of a second inflatable sealing element 502B, thereby inflating second inflatable sealing element 502B. The air then passes through an outlet (not shown) of second inflatable sealing element, through tubing 543, and enters inlet (not shown) of third inflatable sealing element 502C, thereby inflating third inflatable sealing element 502C. An outlet (not shown) of third inflatable sealing element 502C may be sealed or capped to prevent air from leaking, thereby sealing the air within the first, second, and third sealing elements 502A, 502B, 502C.

Figure 6:
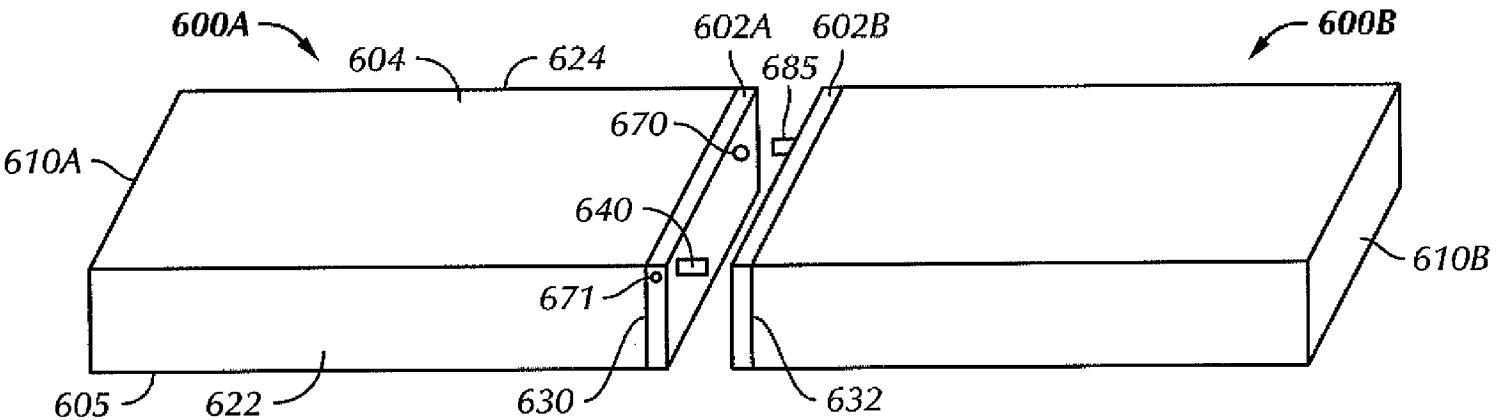
FIG. 6 shows a perspective view of a shaker screen in accordance with embodiments disclosed herein.

Referring now to FIG. 6, a screen sealing system in accordance with embodiments disclosed herein is shown. In this embodiment, a first screen 600A is disposed adjacent a second screen 600B in a vibratory shaker (not shown). Shaker screens 600A, 600B include screen frames 610A, 610B, respectively. At least one filtering element (not shown), as discussed above, may be attached to each screen frame 610A, 610B. In one embodiment, a first inflatable sealing element 602A is disposed along at least a portion of a perimeter of an outer surface 630 of first screen 600A. As shown, inflatable sealing element 602A may extend from top surface 604 to bottom surface 605 of screen frame 610A. However, one of ordinary skill in the art will appreciate that first inflatable sealing element 602A may extend along a selected portion between top surface 604 and bottom surface 605. Furthermore, although shown to extend from a first side 622 to a second side 624 of screen frame 610A, inflatable sealing element 602A may extend along a selected portion or portions between first side 622 and second side 624. Accordingly, the size and shape of inflatable sealing element 602A may vary without departing from the scope of embodiments disclosed herein.

In the embodiment shown, a second inflatable sealing element 602B is disposed along at least a portion of a perimeter of an outer surface 632 of second screen 600B. In use, second inflatable sealing element 602B may be disposed proximate first inflatable sealing element 602A. First inflatable sealing element 602A may have a plurality of inlets 670, 671 and at least one outlet 640. Similarly, second inflatable sealing element 602B may have at least one inlet (not shown) and at least one outlet 685. In this embodiment, the outlet 640 of first inflatable sealing element 602A and inlet (not shown) of the second inflatable sealing element 602B are in fluid communication. Additionally, the outlet 685 of second inflatable sealing element 602B is in fluid communication with the inlet 670 of first inflatable sealing element 602A. The inflatable sealing elements 602A, 602B may be in fluid communication by any means known in the art. For example, as shown, outlets 640, 685 may include molded fittings known in the art that may be, for example, co-molded with, insert-molded with, or attached to inflatable sealing elements 602A, 602B.

Figure 7:
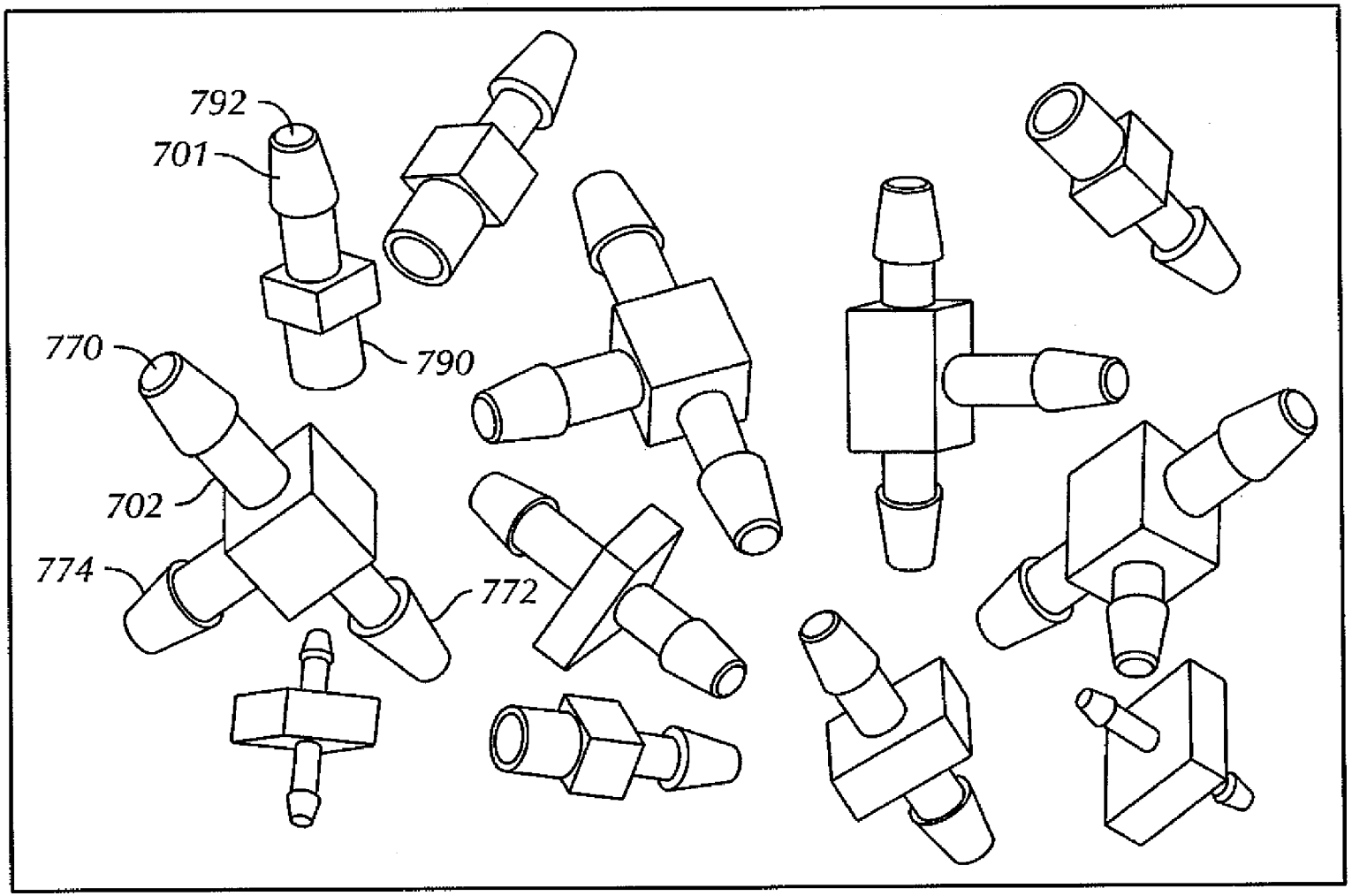
FIG. 7 shows a perspective view of a fitting in accordance with embodiments disclosed herein.

Examples of molded fitting are shown in FIG. 7. One of ordinary skill in the art will appreciate that fittings 701, 702 may include two or more ends configured to couple two or more components (e.g., inflatable sealing elements) together. For example, in one embodiment, a first end 790 of fitting 701 may be coupled to first inflatable sealing elements 602A (FIG. 6) by any method know in the art. For example, fitting 701 may be co-molded, insert-molded, or attached by an adhesive or other known methods of attachment to first inflatable sealing element 602A. A second end 792 of fitting 701 is configured to engage an inlet (not shown) of second inflatable sealing element 602B. Thus, when air is injected into first inflatable sealing element 602A, for example, through inlet 671, air inflates first inflatable sealing element 602A and passes through outlet 640, which may include fitting 701. Air passing through outlet 640 may then enter second inflatable sealing element 602B, thereby inflating second inflatable sealing element 602B.

In another embodiment, a fitting may include three ends, for example, fitting 702. Fitting 702 may used to couple at least three components together. In one embodiment, fitting 702 may be coupled to first inflatable sealing element 602A by any method known in the art, as discussed above. A first end 772 may be configured to inject air into first inflatable sealing element 602A. A second end 774 may be configured to engage the inlet (not shown) of second inflatable sealing element 602B, while a third end 770 may be configured to engage an inlet (not shown) of a third inflatable sealing element (not shown), or alternatively, to receive air from an air supply.

One of ordinary skill in the art will appreciate that fittings 701, 702 may be used to couple inflatable sealing elements of any of the embodiments disclosed herein, for example, the inflatable sealing elements shown in FIGS. 3-5. Fittings 701, 702 may provide fluid communication between a first inflatable sealing element and any adjacent inflatable sealing element. As shown, when assembled and fitted into a corresponding opening or complementary fitting, fittings 701, 702 may provide a sealed pathway for air to flow from a first inflatable sealing element to a second inflatable sealing element. One of ordinary skill in the art will appreciate that fittings 701, 702 may be formed from any material known in the art, including, but not limited to, rubbers, plastics, thermoplastic elastomers ("TPE"), polychloroprene, polypropylene, nylon, mylar, composites, and/or any combinations thereof.

Referring back to FIG. 6, as shown, inlets 670 may include, for example, a tubular opening or a one-way valve configured to receive outlets 640, 685, thereby forming a seal around outlets 640, 685. One or ordinary skill in the art will appreciate that any other male/female type configuration (e.g., threadedly connected) may be used without departing from the scope of embodiments disclosed herein.

In one embodiment, a fluid supply (not shown), for example, an air hose extending from an air pump, may be connected to inlet 671 to inject air into inflatable sealing element 602A. The air may pass through outlet 640 of first screen frame 610A and into inlet (not shown) of second screen frame 610B, thereby inflating both first and second inflatable sealing elements 602A, 602B.

One of ordinary skill in the art will appreciate that a plurality of shaker screens may be disposed within a vibratory shaker. Each shaker screen having a screen frame may include an inflatable sealing element disposed thereon. Accordingly, one of ordinary skill in the art will appreciate that a plurality of inflatable sealing elements may be used in accordance with embodiments disclosed herein. In one embodiment, a shaker screen may have one, two, three, or any number of inflatable sealing elements. In another embodiment a sealing system may include one, two, three, or any number of shaker screens, each having one, two, three, or any number of inflatable sealing elements in sealing engagement. Accordingly, the number, shape, and/or size of the shaker screen or inflatable sealing element may vary without departing from scope of embodiments disclosed herein.

Advantageously, embodiments disclosed herein may provide a more efficient seal for a screen frame assembly within a shale shaker. Some embodiments may provide a more efficient interlocking sealing system. Further, embodiments disclosed herein may reduce the amount of unfiltered drilling fluids and drilling particulates from bypassing the screen frames disposed in a shale shaker.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A shaker screen sealing system comprising:

a first screen frame;

a first inflatable sealing element disposed along a surface of the first screen frame, the first inflatable sealing element having an inlet and an outlet;

a second screen frame;

a second inflatable sealing element disposed along a surface of the second screen frame, the second inflatable sealing element having an inlet; and wherein the outlet of the first inflatable sealing element is in fluid communication with the inlet of the second inflatable sealing element such that during inflation a fluid injected into the inlet of the first inflatable sealing element inflates both the first and second inflatable sealing elements.

2. The shaker screen sealing system of claim 1, wherein the first and second screen frames comprise an interlocking system.

3. The shaker screen sealing system of claim 1, further comprising a connector that extends from the outlet of the first inflatable sealing element to the inlet of the second inflatable sealing element for providing fluid communication between the first and second inflatable sealing elements.

4. The shaker screen sealing system of claim 3, wherein the connector is selected from a group consisting of a tubing and a fitting.

5. The shaker screen sealing system of claim 1, wherein the first and second screen frames comprise a composite material.

6. The shaker screen sealing system of claim 1, wherein the first inflatable sealing element is disposed along at least a portion of a perimeter of the first screen frame, and wherein the second inflatable sealing element is disposed along at least a portion of a perimeter of the second screen frame, the portion selected from a group consisting of a top surface, a bottom surface, and an outer surface.

7. The shaker screen sealing system of claim 1, wherein one of the first and second inflatable sealing elements has a female connection shape, and wherein the other of the first and second inflatable sealing elements has a male connection shape, such that upon inflation the first inflatable sealing element and the second inflatable sealing element engage in a sealing and interlocking arrangement.

8. A screen sealing system comprising:

a first screen frame;

a first inflatable sealing element disposed along a surface of the first screen frame, the first inflatable sealing element having an inlet and an outlet;

a second screen frame;

a second inflatable sealing element disposed along a surface of the second screen frame, the second inflatable sealing element having an inlet and an outlet; and a first connector that extends from the outlet of the first inflatable sealing element to the inlet of the second inflatable sealing element for providing fluid communication between the first and second inflatable sealing elements such that during inflation a fluid injected into the inlet of the first inflatable sealing element inflates both the first and second inflatable sealing elements.

9. The screen sealing system of claim 8, wherein the first inflatable sealing element is disposed along at least a portion of a perimeter of the first screen frame, and wherein the second inflatable sealing element is disposed along at least a portion of a perimeter of the second screen frame, the portion selected from a group consisting of a top surface, a bottom surface, and an outer surface.

10. The screen sealing system of claim 9, wherein the first inflatable sealing element disposed along a top surface of the first screen frame is configured to inflate and engage a bracing surface attached to an inside wall of a shaker basket, and wherein the second inflatable sealing element disposed along a top surface of the second screen frame is configured to inflate and engage a bracing surface attached to an inside wall of a shaker basket.

11. The screen sealing system of claim 8, wherein the first connector is selected from a group consisting of a tubing and a fitting.

12. The screen sealing system of claim 8, further comprising an air supply in fluid communication with the inlet of the first inflatable sealing element.

13. The screen sealing system of claim 8, wherein the outlet of the second inflatable sealing element is sealed.

14. The screen sealing system of claim 8, wherein the first and second screen frames comprise an interlocking system.

15. The screen sealing system of claim 14, wherein the interlocking system comprises a hooked protrusion on one of the first and second screen frames that is configured to engage a groove of a on the other of the first and second screen frames.

16. The screen sealing system of claim 8, further comprising:

a third inflatable sealing element disposed along a surface of the second screen frame, the third inflatable sealing element having an inlet; and a second connector that extends from the outlet of the second inflatable sealing element to the inlet of the third inflatable sealing element for providing fluid communication between the second and third inflatable sealing elements.

17. The screen sealing system of claim 16, wherein the third inflatable sealing element is configured to inflate and engage an inside wall of a shaker basket.

18. The screen sealing system of claim 8, wherein one of the first and second inflatable sealing elements has a female connection shape, and wherein the other of the first and second inflatable sealing elements has a male connection shape, such that upon inflation the first inflatable sealing element and the second inflatable sealing element engage in a sealing and interlocking arrangement.

19. The screen sealing system of claim 18, further comprising:

a third inflatable sealing element disposed along a surface of the second screen frame, the third inflatable sealing element having an inlet; and a second connector that extends from the outlet of the second inflatable sealing element to the inlet of the third inflatable sealing element for providing fluid communication between the second and third inflatable sealing elements.

20. The screen sealing system of claim 19, wherein the second connector is selected from a group consisting of a tubing and a fitting.

21. The screen sealing system of claim 19, wherein the first and second connectors provide fluid communication such that during inflation a fluid injected into the inlet of the first inflatable sealing element inflates the first, second, and third inflatable sealing elements.

* * * * *